US008272805B1

(12) United States Patent
Dinnison

(10) Patent No.: US 8,272,805 B1
(45) Date of Patent: Sep. 25, 2012

(54) PORTABLE WEDGE CLAMP DEVICE

(76) Inventor: Jay G. Dinnison, Seattle, WA (US)

( * ) Notice: Subject to any disclaimer, the term of this patent is extended or adjusted under 35 U.S.C. 154(b) by 27 days.

(21) Appl. No.: 13/102,883

(22) Filed: May 6, 2011

(51) Int. Cl.
*B25G 3/28* (2006.01)

(52) U.S. Cl. ..... 403/374.1; 403/379.4; 403/408.1; 403/409.1

(58) Field of Classification Search .... 403/374.1–374.4, 403/334, 109.5, 379.4, 368, 370, 408.1, 409.1; 269/190, 234
See application file for complete search history.

(56) References Cited

U.S. PATENT DOCUMENTS 506,388 A * 10/1893 Clark ..... 292/355
1,011,245 A * 12/1911 Rafter ..... 238/107
1,234,020 A * 7/1917 Harp ..... 411/101
3,307,699 A * 3/1967 Shira ..... 209/403
4,078,276 A * 3/1978 Nunes ..... 16/271
4,449,687 A * 5/1984 Karaktin ..... 248/220.22
4,667,561 A * 5/1987 Storey et al. ..... 84/314 N
4,858,865 A * 8/1989 Schrepfer ..... 248/188.2
5,785,461 A * 7/1998 Lambert ..... 403/167
7,905,465 B1 * 3/2011 Anwar ..... 248/673
8,137,022 B2 * 3/2012 Carmel ..... 403/150

* cited by examiner

*Primary Examiner* — Joshua Kennedy
(74) *Attorney, Agent, or Firm* — Charles J. Rupnick

(57) ABSTRACT

A portable wedge clamp having both a drive wedge member and a mating base wedge member each formed with generally wedge shaped bodies that are oppositely inclined along a mutually slidable wedge interface. The body of the base wedge member is formed with an external load application surface opposite from the mutual wedge interface, and the body of the drive wedge member is formed with a load reaction surface opposite from the mutual wedge interface. The external load application surface of the base wedge member and the external load reaction surface of the drive wedge member are spaced apart on opposite sides of the mutual wedge interface. Accordingly, the external load application and load reaction surfaces of the respective base wedge and drive wedge member bodies are arranged in a substantially parallel opposing relationship when the base and drive wedge members are slidably juxtaposed along the inclined wedge interface therebetween.

20 Claims, 10 Drawing Sheets

PORTABLE WEDGE CLAMP DEVICE

FIELD OF THE INVENTION

The present invention relates generally to clamps, and in particular to portable wedge clamps having a drive screw for drawing a drive wedge portion together with a base wedge portion with an inclined interface therebetween.

BACKGROUND OF THE INVENTION

Clamps are generally well-known. However, known clamps are limited in their ability to provide the effective clamping in an efficient and reliable manner.

SUMMARY OF THE INVENTION

The present invention is a portable wedge clamp device having both a drive wedge member and a mating base wedge member, each formed of respective generally wedge shaped bodies that are oppositely inclined along a mutually slidable wedge interface that is inclined therebetween. The wedge shaped body of the base wedge member is formed with an external load application surface opposite from the mutual wedge interface, and the wedge shaped body of the drive wedge member is formed with a load reaction surface opposite from the mutual wedge interface. The external load application surface of the base wedge member and the external load reaction surface of the drive wedge member are spaced apart on opposite sides of the mutual wedge interface. Accordingly, the external load application and load reaction surfaces of the respective base wedge and drive wedge member bodies are arranged in a substantially parallel opposing relationship when the respective base and drive wedge members are slidably juxtaposed along the mutual wedge interface inclined therebetween.

The load application surface of the base wedge member may be appropriately contoured to slidingly mate with a contoured clamping surface on the target workpiece that is to be clamped, whereby the target workpiece is easily moveable relative to an anvil member when the portable wedge clamp device is in its collapsed configuration. Cooperating load application passages are formed through the drive wedge and base wedge members through which a load application member passes for clamping the external workpiece against the separate external anvil member. The load application passage of the base wedge member is, for example, a substantially round hole that extends between the external load application surface of the base wedge member and its opposing wedge interface surface that is positioned along the mutual wedge interface between the mating drive wedge and base wedge members. The load application passage of the drive wedge member is an oblong slot that extends between its wedge interface surface that is also positioned along the mutual wedge interface between the mating drive wedge and base wedge members, and its external load reaction surface opposite therefrom. The oblong load application slot is arranged with its elongated lengthwise dimension extended along the incline of the slidable wedge interface surface between the mating drive wedge and base wedge members. In an operational mode of the portable wedge clamp device assembly, the respective base wedge and drive wedge members are slidably juxtaposed along the mutual wedge interface inclined therebetween, and the cooperating load application passages remain substantially aligned between the respective base wedge and drive wedge members.

In operation of the portable wedge clamp device, the load application member passes through the cooperating load application passages of the respective mating drive wedge and base wedge members, through a separate external target workpiece member that is to be clamped, and into a separate external anvil member for clamping the target workpiece against the anvil member. The load application member is, for example, another threaded screw or bolt, is arranged to pass through the drive wedge and base wedge members and the target workpiece member, and thread into the anvil member.

In operation, the cooperating drive wedge and base wedge members of the portable wedge clamp device are mutually slidable along the inclined mutual wedge interface between an initial collapsed configuration having the load application member positioned relaxed in the cooperating load application passages between the wedge shaped bodies, whereby the target workpiece is loose and can be moved away from contact with the anvil member, and a final expanded configuration having the load application member tensioned in the cooperating load application passages between the opposing external load application and load reaction surfaces of the respective base and drive wedge member bodies, whereby the target workpiece is immovably clamped against the anvil member.

In the initial collapsed configurations of the cooperating drive wedge and base wedge members, the cooperating load application passages are cooperatively aligned in a substantially perpendicular orientation to both the external load application surface of the base wedge member and the opposing load reaction surface of the mating drive wedge member. During operation while the drive wedge member is slid along the wedge interface toward the final expanded configuration of the portable wedge clamp device, the cooperating load application passages constantly remain cooperatively aligned in the substantially perpendicular orientation relative to both the external load application surface of the base wedge member and the opposing load reaction surface of the mating drive wedge member. However, between the initial collapsed and final expanded configurations of the cooperating drive wedge and base wedge members, the load application passage of the drive wedge member moves along the load application passage of the base wedge member from an initial position adjacent to a narrow end portion of the wedge shaped body of the base wedge member toward a final position adjacent to a thick end portion of the wedge shaped body of the base wedge member as the drive wedge member moves relative to the base wedge member along the inclined wedge interface therebetween.

The portable wedge clamp of the invention further includes an actuation member, such as either a threaded rod, bolt or screw, or an alternative cam mechanism. The actuation member is coupled between the drive wedge and base wedge members for moving the drive wedge member relative to the base wedge member slidingly along the mutual wedge interface therebetween. For example, the actuation member draws the drive wedge member slidingly along the wedge interface from the initial collapsed configuration having the load application member positioned adjacent to a distal end of the slotted load application passage adjacent to the narrow end of the wedge shaped body, and the final expanded configuration having the load application member positioned adjacent to the proximal end of the slotted load application passage adjacent to a wide end of the wedge shaped body. In the initial collapsed configuration of the portable wedge clamp device, the drive wedge member is positioned along the mutual wedge interface relative to the base wedge member such that the narrow end of its wedge shaped drive body is spaced in its closest position relative to the narrow end of the wedge shaped body of the base wedge member. Accordingly, in the initial collapsed configuration of the portable wedge clamp device, the external load reaction surface of the drive wedge member is spaced in its closest position relative to the load application surface of the base wedge member, whereby the wedge clamp device is collapsed and the load application member is substantially free to move along the load application passages.

According to one aspect of the invention a method of clamping utilizing a portable wedge clamp device is disclosed herein.

Other aspects of the invention are detailed herein.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 3 and FIG. 4 both illustrate the same portable wedge clamp illustrated in FIG. 1, wherein FIG. 3 illustrates the portable wedge clamp of FIG. 1 configured in the initial collapsed configuration illustrated in FIG. 1, and FIG. 4 illustrates the portable wedge clamp of FIG. 1 configured in the final expanded configuration illustrated in FIG. 2;

DETAILED DESCRIPTION OF PREFERRED EMBODIMENT

As required, a detailed illustrative embodiment of the present portable wedge clamp device is disclosed herein. However, techniques, systems and operating structures in accordance with the present portable wedge clamp device may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present portable wedge clamp device. The following presents a detailed description of an illustrative embodiment (as well as some alternative embodiments) of the present portable wedge clamp device.

In the Figures, like numerals indicate like elements.

Figure 1:
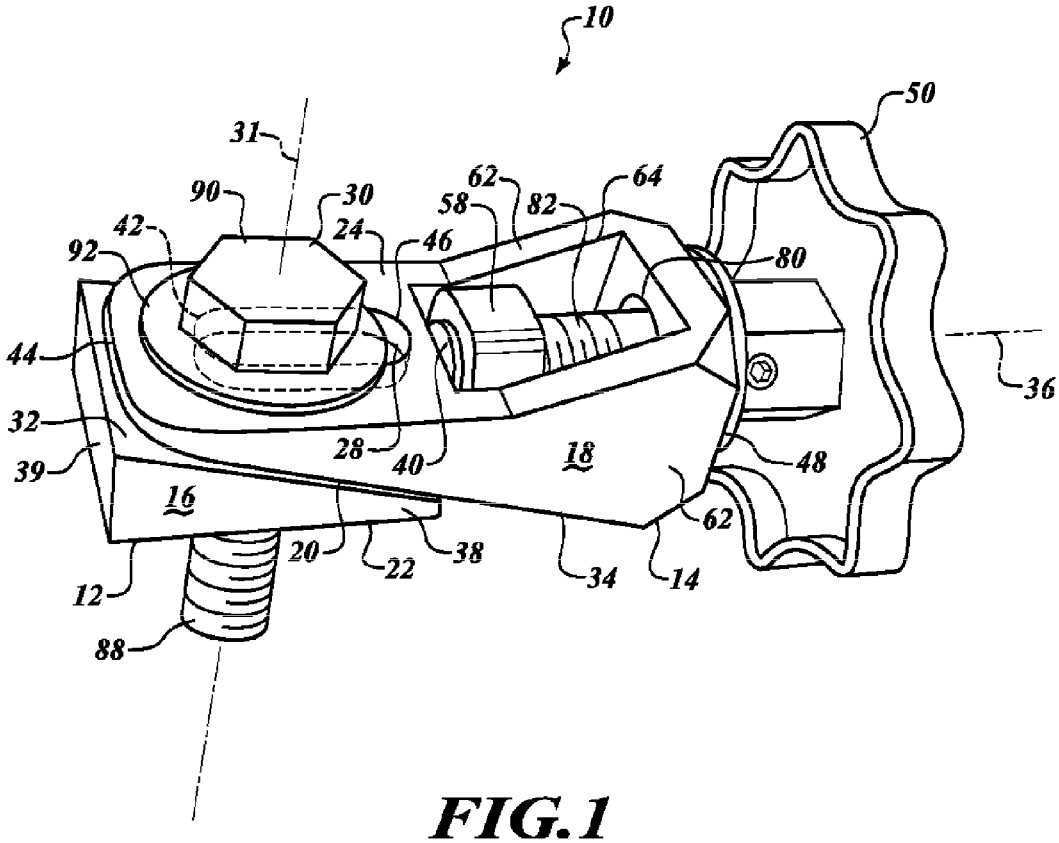
FIG. 1 is a perspective view showing an example of the portable wedge clamp device of the invention having both a rigid base wedge member and a cooperating rigid drive wedge member that are slidable along a mutually inclined wedge interface therebetween, wherein the cooperating base wedge and drive wedge members configured in an initial collapsed configuration.

FIG. 1 illustrates a portable wedge clamp device 10 having both a rigid base wedge member 12 and a cooperating rigid drive wedge member 14, each formed of respective generally wedge shaped bodies 16 and 18 that are oppositely inclined along a mutually slidable wedge interface 20 that is inclined between wedge bodies 16, 18. Wedge shaped body 16 of base wedge member 12 is formed with an external load application surface 22 opposite from mutual wedge interface 20, and wedge shaped body of drive wedge member 14 is formed with a load reaction surface 24 opposite from mutual wedge interface 20. External load application surface 22 of base wedge member 12 and external load reaction surface 24 of drive wedge member 14 are spaced apart on opposite sides of mutual wedge interface 20. Accordingly, external load application surface 22 and load reaction surface 24 of respective base wedge and drive wedge member bodies 18, 16 are arranged in a substantially parallel opposing relationship when respective base wedge and drive wedge members 14, 12 are slidably juxtaposed along mutual wedge interface 20 inclined therebetween.

Load application surface 22 of base wedge member 12 may be appropriately contoured to slidingly mate with a contoured clamping surface T1 on a separate target workpiece T that is to be clamped, whereby target workpiece T is easily moveable relative to a separate anvil member A (as illustrated in subsequent Figures) when portable wedge clamp device 10 is in its collapsed configuration. Cooperating load application passages 26 and 28 are formed through base wedge member 12 and drive wedge member 14. A rigid load application member 30 passes through cooperating load application passages 26, 28 of base wedge and drive wedge members 12, 14 along a load application axis 31 for clamping target workpiece T against separate external anvil member A. Load application passage 26 of base wedge member 12 is, for example, a substantially round hole that extends between external load application surface 22 of base wedge member 12 and its opposing wedge interface surface 32 that is positioned along mutual wedge interface 20 between mating base wedge and drive wedge members 12, 14. Load application passage 28 of drive wedge member 14 is an oblong slot that extends between its external load reaction surface 24 and its wedge interface surface 34 opposite therefrom that is also positioned along mutual wedge interface 20 between mating base wedge and drive wedge members 12, 14. Oblong load application slot is arranged with its elongated lengthwise dimension extended along incline of slidable wedge interface 20 between mating base wedge and drive wedge members 12, 14. In an operational mode of portable wedge clamp device assembly, respective base wedge and drive wedge members 12, 14 are slidably juxtaposed along mutual wedge interface 20 inclined therebetween, and cooperating load application passages 26, 28 remain substantially aligned between respective base wedge and drive wedge members 12, 14.

In operation of portable wedge clamp device, load application member 30 passes through cooperating load application passages 26, 28 of respective mating base wedge and drive wedge members 12, 14, through a separate external target workpiece member T that is to be clamped, and into a separate external anvil member A for clamping target workpiece T against anvil member A. Load application member 30 is, for example, another threaded screw or bolt, is arranged to pass through base wedge and drive wedge members 12, 14 and target workpiece T member, and thread into anvil member A.

In operation, cooperating base wedge and drive wedge members 12, 14 of portable wedge clamp device 10 are mutually slidable along inclined mutual wedge interface 20 between an initial collapsed configuration wherein wedge members 12, 14 are collapsed along a wedge drive axis 36 and having opposing wedge interface surfaces 32, 34 spaced apart a minimum distance along load application axis 31 with load application member 30 positioned relaxed, i.e. unstressed, in cooperating load application passages 26, 28 between wedge shaped bodies 16, 18, whereby target workpiece T is loose and can be moved away from contact with anvil member A, and a final expanded configuration wherein wedge members 12, 14 are expanded along wedge drive axis 36 and having opposing wedge interface surfaces 32, 34 spaced apart a maximum distance along load application axis 31 with load application member 30 tensioned in cooperating load application passages 26, 28 between opposing external load application and load reaction surfaces 22, 24 of respective base and drive wedge member bodies 16, 18, whereby target workpiece T is immovably clamped against anvil member A.

In the initial collapsed configurations of cooperating base wedge and drive wedge members 12, 14, cooperating load application passages 26, 28 are cooperatively aligned in a substantially perpendicular orientation to both external load application surface 22 of base wedge member 12 and opposing load reaction surface 24 of mating drive wedge member 14. During operation while drive wedge member 14 is slid along wedge interface 20 toward the final expanded configuration of portable wedge clamp device 10, cooperating load application passages 26, 28 constantly remain cooperatively aligned in substantially perpendicular orientation relative to both external load application surface 22 of base wedge member 12 and opposing load reaction surface 24 of mating drive wedge member 14. However, between the initial collapsed and final expanded configurations of cooperating base wedge and drive wedge members 12, 14, load application passage 28 of drive wedge member 14 moves along load application passage 26 of base wedge member 12 from an initial position adjacent to a narrow end portion 38 of wedge shaped body 16 of base wedge member 12 toward a final position adjacent to a thick end portion 39 of wedge shaped body 16 as drive wedge member 14 moves relative to base wedge member 12 slidingly along inclined wedge interface 20 therebetween.

In portable wedge clamp device 10, load application member 30 is extended through cooperating load application passages 26, 28 between base wedge and drive wedge members 12, 14. A rigid actuation member 40, such as either a threaded rod, bolt or screw, or an alternative cam mechanism, is coupled between base wedge and drive wedge members 12, 14 for moving drive wedge member 14 relative to base wedge member 12 slidingly along mutual wedge interface 20 therebetween. For example, actuation member 40 draws drive wedge member 14 slidingly along wedge interface 20 from the initial collapsed configuration having load application member 30 positioned adjacent to a distal end 42 of slotted load application passage 28 adjacent to a narrow end 44 of wedge shaped body 18, and the final expanded configuration having load application member 30 positioned adjacent to a proximal end 46 of slotted load application passage 28 adjacent to a thick end portion 48 of wedge shaped body 18. In the initial collapsed configuration of portable wedge clamp device 10, drive wedge member 14 is positioned along mutual wedge interface 20 relative to base wedge member 12 such that narrow end 44 of its wedge shaped drive body 18 is spaced in its closest position relative to narrow end portion 38 of wedge shaped body 16 of base wedge member 12. Accordingly, in the initial collapsed configuration of portable wedge clamp device 10, external load reaction surface 24 of drive wedge member 14 is spaced in its closest position relative to load application surface 22 of base wedge member 12, whereby wedge clamp device 10 is collapsed and load application member 30 is substantially free to move along load application passages 26, 28.

Portable wedge clamp 10 is illustrated here having cooperating base wedge and drive wedge members 12, 14 configured in the initial collapsed configuration, wherein load reaction surface 24 is spaced closest to load application surface 22 across mutual wedge interface 20, and load application member 30 is relaxed along load application axis 31 in cooperating load application passages 26, 28 between wedge shaped bodies 16, 18 thereof.

A hand wheel or other actuator handle 50 is coupled for operating actuation member 40.

Figure 2:
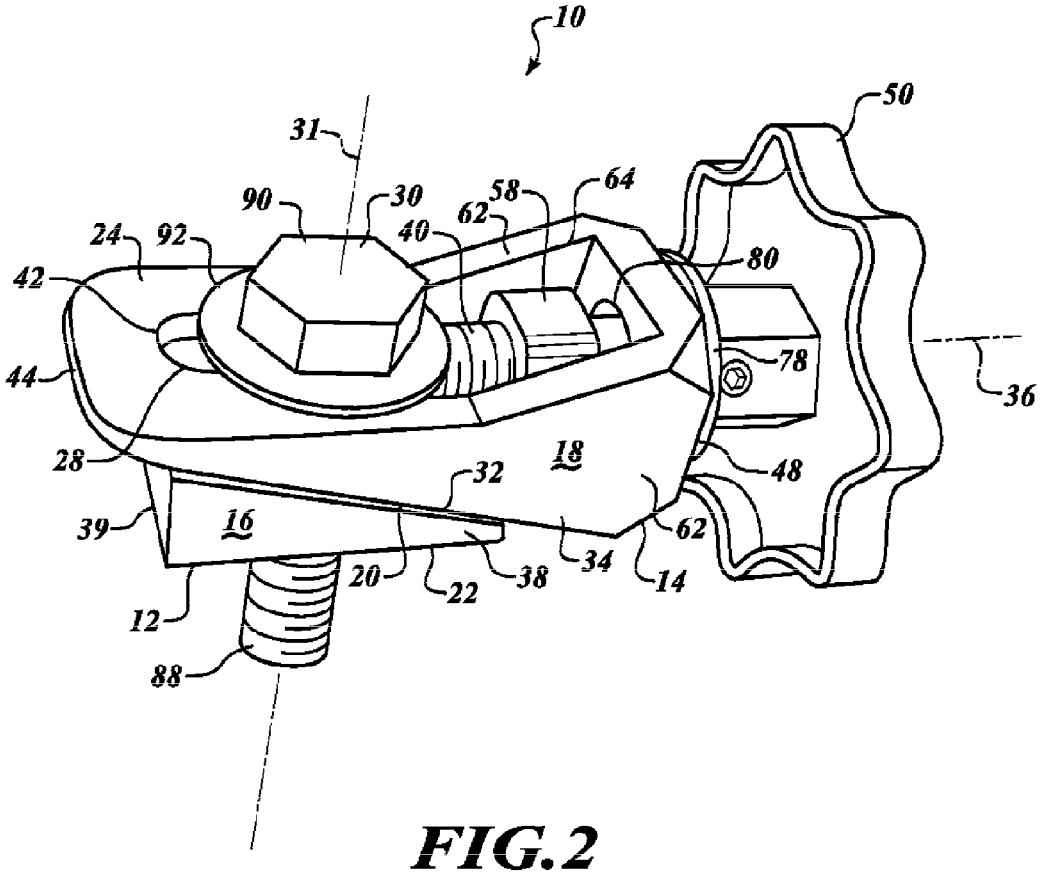
FIG. 2 illustrates the same portable wedge clamp illustrated in FIG. 1 having the cooperating base wedge and drive wedge members configured in a final expanded configuration.

FIG. 2 illustrates portable wedge clamp 10 having cooperating base wedge and drive wedge members 12, 14 configured in the final expanded configuration, wherein load reaction surface 24 is spaced farthest away from load application surface 22 across mutual wedge interface 20, and load application member 30 is tensioned along load application axis 31 in cooperating load application passages 26, 28 between wedge shaped bodies 16, 18 thereof.

Figure 3:
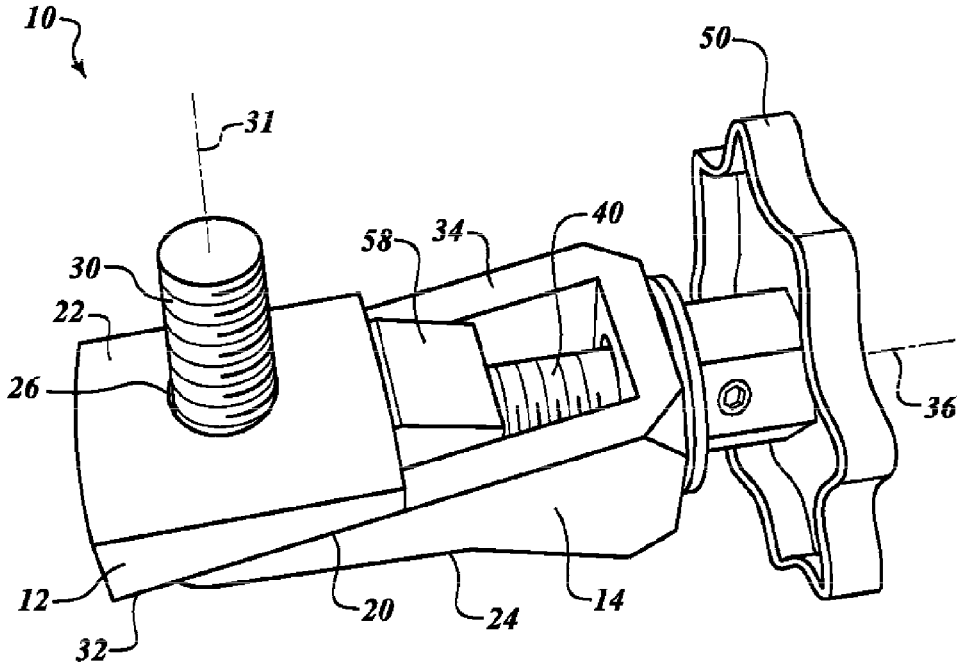
Figure 4:
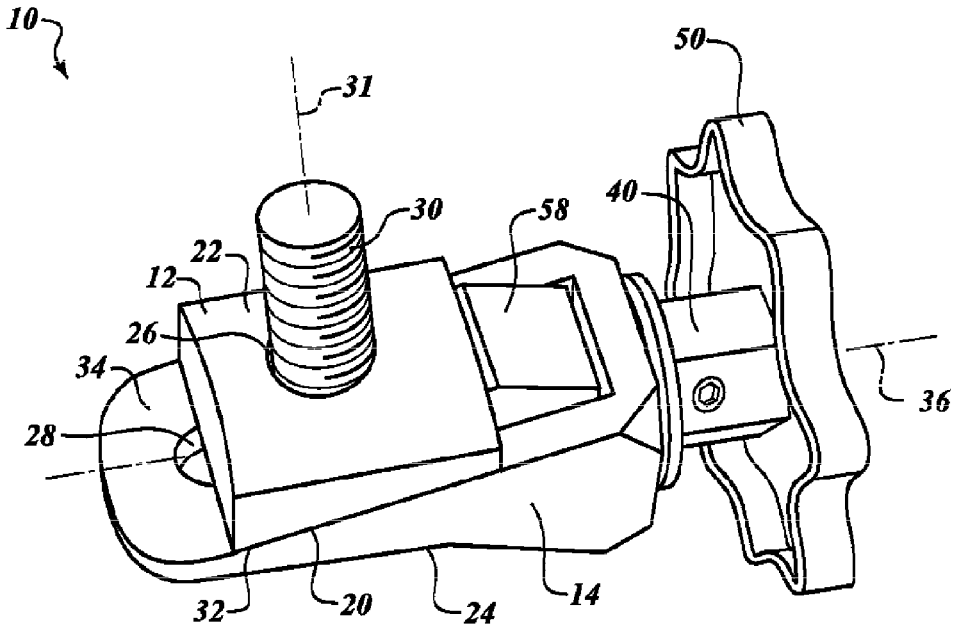

FIG. 3 and FIG. 4 are views of portable wedge clamp 10. FIG. 3 illustrates portable wedge clamp 10 in its initial collapsed configuration, wherein wedge members 12, 14 are collapsed along wedge drive axis 36 by actuation member 40 interacting between base wedge and drive wedge members 12, 14 for positioning drive wedge member 14 relative to base wedge member 12 slidingly along mutual wedge interface 20 therebetween. Actuation member 40 is threadedly coupled with an anchor collar 58 of base wedge member 12 for slidingly driving wedge interface surface 34 of driving drive wedge member 14 along wedge interface 20 into the collapsed position relative to wedge interface surface 32.

FIG. 4 illustrates portable wedge clamp 10 in its final expanded configuration. Here, wedge members 12, 14 are expanded along wedge drive axis 36 with opposing wedge interface surfaces 32, 34 spaced apart a maximum distance along load application axis 31. Load application member 30 is tensioned in cooperating load application passages 26, 28 between opposing external load application and load reaction surfaces 22, 24 of respective base and drive wedge member bodies 16, 18. Cooperating wedge members 12, 14 are expanded along wedge drive axis 36 by actuation member 40 interacting between base wedge and drive wedge members 12, 14 for positioning drive wedge member 14 relative to base wedge member 12 slidingly along mutual wedge interface 20 therebetween. Actuation member 40 is threadedly operated with anchor collar 58 of base wedge member 12 for slidingly pulling wedge interface surface 34 of driving drive wedge member 14 along wedge interface 20 into the final expanded position relative to wedge interface surface 32.

Figure 5:
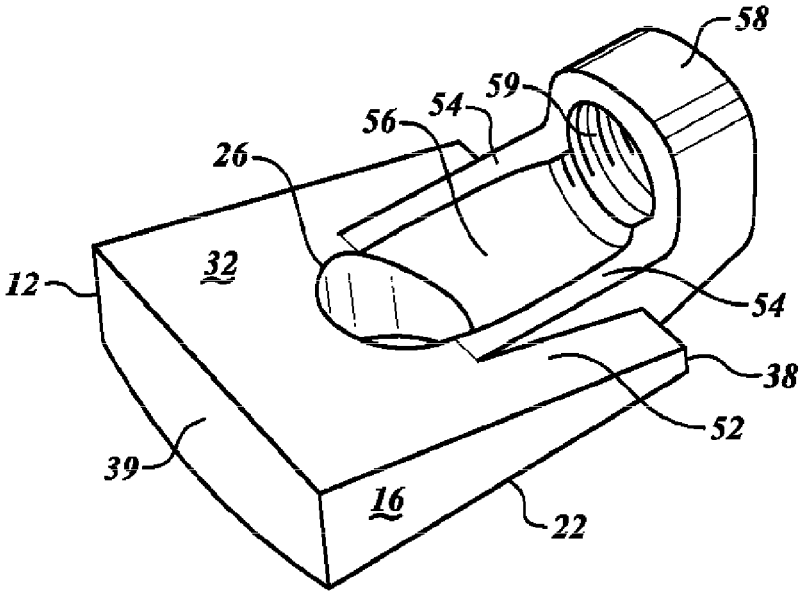
FIG. 5 and FIG. 6 are different views of the base wedge member of the same invention illustrated in FIGS. 1 and 2.
Figure 6:
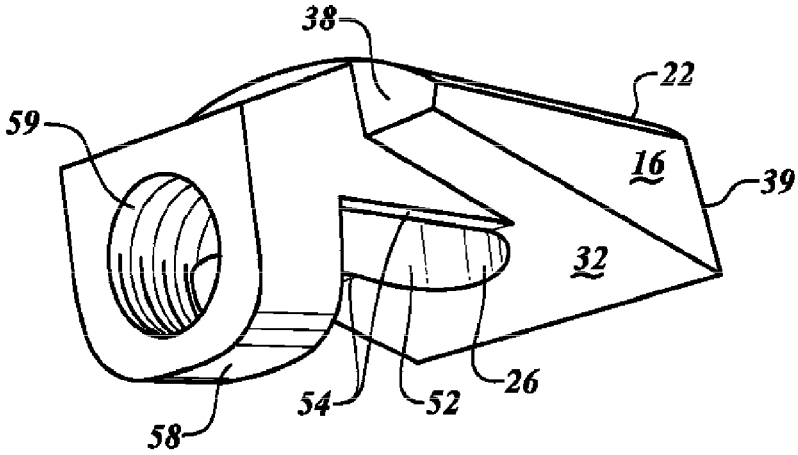

FIG. 5 and FIG. 6 are different views of base wedge member 12, wherein load application passage 26 is illustrated as a substantially round hole that extends through wedge shaped body 16 between its external load application surface 22 and its opposing wedge interface surface 32 that is positioned along mutual wedge interface 20 between mating base wedge and drive wedge members 12, 14. Load application passage 26 is positioned adjacent to thick end portion 39 of wedge shaped body 16. A central portion 52 of wedge interface surface 32 is formed with a pair of spaced apart gussets 54 with a trough 56 extending from load application passage 26 to anchor collar 58 thereof adjacent to narrow end portion 38 of wedge shaped body 16. Anchor collar 58 cooperates with actuation member 40 for drawing drive wedge member 14 slidingly along wedge interface 20 away from the initial collapsed configuration with base wedge member 12 toward the final expanded configuration. Anchor collar 58 also cooperates with actuation member 40 for drawing drive wedge member 14 slidingly along wedge interface 20 away from the final expanded configuration with base wedge member 12 toward the initial collapsed configuration. Anchor collar 58 is, for example, formed with a female thread 59 structured to cooperate with threaded actuation member 40 for operating portable wedge clamp 10.

Figure 7:
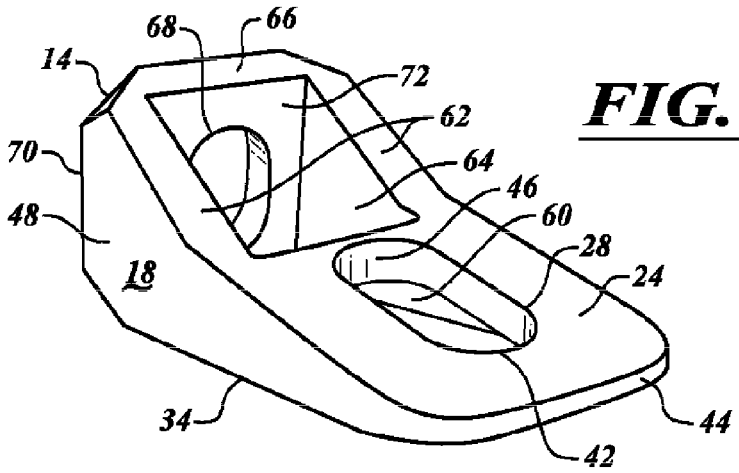
FIG. 7, FIG. 8 and FIG. 9 are different views of the drive wedge member of the same invention illustrated in FIGS. 1 and 2.
Figure 8:
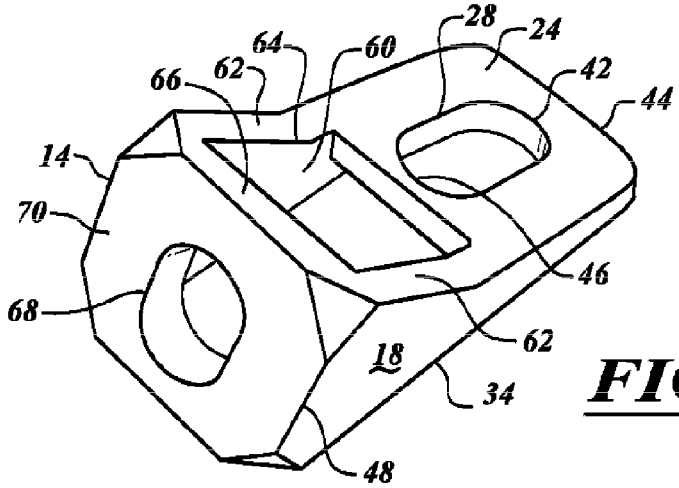
Figure 9:
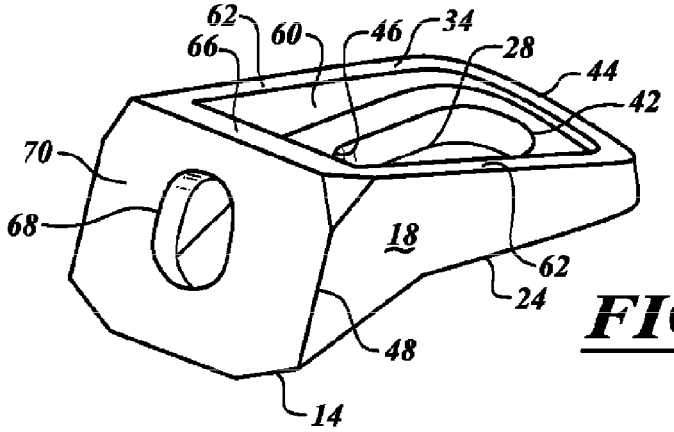

FIG. 7, FIG. 8 and FIG. 9 are different views of drive wedge member 14 wherein load application passage 28 is illustrated as an oblong slot that extends through wedge shaped body 18 between its external load reaction surface 24 and its and opposing wedge interface surface 34 that is also positioned along mutual wedge interface 20 between mating base wedge and drive wedge members 12, 14. Wedge shaped body 18 of drive wedge member 14 is formed with a hollow 60 to provide clearance for movement of anchor collar 58 of base wedge member 12 between a pair of opposing spaced apart side wall portions 62 that form wedge interface surface 34. A cutout 64 is provided in load reaction surface 24 at thick end portion 48 of wedge shaped body 18 between load application passage 28 and an actuator reaction portion 66 of drive wedge member 14 adjacent to thick end 48 of wedge body 18 to accommodate anchor collar 58 of base wedge member 12. By example and without limitation, actuator reaction portion 66 is formed as an end wall portion of drive wedge member 14 and oriented substantially perpendicular to wedge drive axis 36.

An actuator drive passage 68 is formed through actuator reaction portion 66 at end wall of drive wedge member 14 substantially along wedge drive axis 36 to form an exterior expansion drive surface 70 on actuator reaction portion 66 at end wall of drive wedge member 14 substantially perpendicular to wedge drive axis 36. Exterior expansion drive surface 70 cooperates with actuation member 40 for driving base wedge and drive wedge members 12, 14 substantially along wedge drive axis 36 away from the initial collapsed configuration into the final expanded configuration, whereby external load application surface 22 of base wedge member 12 is moved along load application axis 31 farther apart from external load reaction surface 24 of drive wedge member 14 on opposite sides of mutual wedge interface 20. Actuator drive passage 68 through actuator reaction portion 66 at end wall of drive wedge member 14 communicates with hollow 60 of wedge body 18, whereby an interior contraction drive surface 72 is formed on actuator reaction portion 66 at end wall of drive wedge member 14 opposite from expansion drive surface 70 and substantially perpendicular to wedge drive axis 36. Interior contraction drive surface 72 cooperates with actuation member 40 for driving base wedge and drive wedge members 12, 14 substantially along wedge drive axis 36 away from the expanded configuration into the collapsed configuration, whereby external load application surface 22 of base wedge member 12 is moved along load application axis 31 toward external load reaction surface 24 of drive wedge member 14 on opposite sides of mutual wedge interface 20. According to one embodiment, actuator drive passage 68 is an oblong slot elongated crosswise of wedge drive axis 36 of portable wedge clamp device 10 for accommodating expansion of wedge members 12, 14. Accordingly, side wall portions 62 of drive wedge body 18 are wider adjacent to actuator reaction portion 66 to accommodate the oblong slot of actuator drive passage 68.

Figure 10:
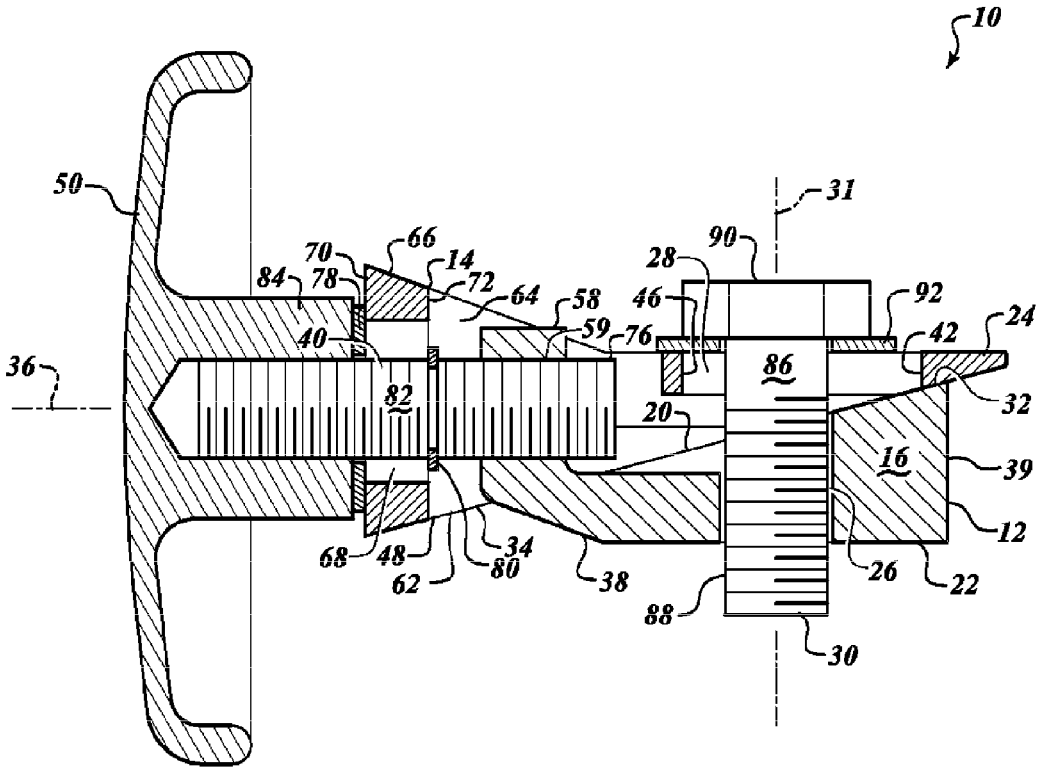
FIG. 10 is a cross-section of the same portable wedge clamp of the same invention illustrated in FIGS. 1 and 2 illustrated here in an intermediate configuration between the collapsed and expanded configurations thereof.

FIG. 10 is a cross-section of portable wedge clamp 10 illustrated in an intermediate configuration between the collapsed and expanded configurations thereof. As illustrated here, wedge interface surface 34 of drive wedge member 14 mates with cooperating wedge interface surface 32 of base wedge member 12 along mutual wedge interface 20 which is inclined at about 15 degrees plus or minus about 5 degrees from an operational drive axis 74 of portable wedge clamp 10. As illustrated, external load reaction surface 24 of drive wedge member 14 is substantially parallel with external load application surface 22 of base wedge member 12.

Anchor collar 58 and spaced apart gussets 54 in central portion 52 of wedge interface surface 32 of base wedge member 12 are slidingly fitted into hollow 60 between spaced apart side wall portions 62 of drive wedge member 14, and respective wedge interface surfaces 32, 34 are slidingly mated along mutual wedge interface 20.

Actuation member 40 is passed through actuator drive passage 68 in actuator reaction portion 66 at end wall of drive wedge member 14 and a threaded portion 76 thereof is threaded into female thread 59 of anchor collar 58. Expansion and contraction actuation portions 78 and 80 are provided on an actuation drive portion 82 of actuation member 40 for driving base wedge and drive wedge members 12, 14 into the final expanded configuration and subsequently collapsing them into their initial collapsed configuration, respectively. For example, actuation drive portion 82 of actuation member 40 is configured as a rigid shaft sized to pass through actuator drive passage 68 in actuator reaction portion 66, and expansion actuation portion 78 is configured as a ring sized larger than actuator drive passage 68 so as to be constrained from passing therethrough when portable wedge clamp 10 is operated, and is further restrained against longitudinal motion on actuation drive shaft portion 82 of actuation member 40 between handle 50 and exterior expansion drive surface 70 on actuator reaction portion 66 at end wall of drive wedge member 14, whereby actuation member 40 is operable for drawing base wedge member 12 along inclined wedge interface 20 toward the final expanded configuration with drive wedge member 14. Contraction actuation portion 80 is configured as a ring sized larger than actuator drive passage 68 so as to be constrained from passing therethrough when portable wedge clamp 10 is operated, and is further restrained against longitudinal motion on actuation drive shaft portion 82 of actuation member 40 between interior contraction drive surface 72 on actuator reaction portion 66 opposite from expansion drive surface 70 and anchor collar 58 of base wedge member 12. Preferably, for ease of operation, both expansion actuation and contraction actuation portions 78, 80 are rotatably mounted on actuation drive shaft portion 82 of actuation member 40. For example, contraction actuation portion 80 is a snap ring captured in a slot formed on actuation member 40. Optionally, expansion actuation portion 78 is also a snap ring captured in a slot formed on actuation member 40. Alternatively, expansion actuation portion 78 is a washer loose between actuator reaction portion 66 at end wall of drive wedge member 14 and an extended portion 84 of actuator handle 50.

Hole load application passage 26 of base wedge member 12 is aligned with oblong slot load application passage 28 of drive wedge member 14. Load application hole passage 26 of base wedge member 12 is aligned with slotted load application passage 28 adjacent to distal end 42 thereof at narrow end 44 of wedge shaped body 18 with load application member 30 relaxed therein along load application axis 31 when portable wedge clamp 10 is in the collapsed configuration. When portable wedge clamp 10 is in the expanded configuration, load application hole passage 26 of base wedge member 12 is aligned with slotted load application passage 28 adjacent to proximal end 46 thereof at thick end portion 48 of wedge shaped body 18 with load application member 30 tensioned therein along load application axis 31.

Load application member 30 is inserted through cooperating load application passages 26, 28 of respective base wedge and drive wedge members 12, 14 and on through target workpiece T into threadedly coupled into external anvil member A. For example, a shaft portion 86 of load application member 30 resides in load application passages 26, 28 of respective wedge members 12, 14, while a threaded end portion 88 thereof passes through target workpiece T is threaded into external anvil member A. A load application portion 90 of load application member 30, such as a screw or bolt head when load application member 30 is a threaded screw or bolt, is positioned on shaft portion 86 opposite from threaded end portion 88 thereof. Load application portion 90 of load application member 30 is also positioned externally of load application passages 26, 28 adjacent to load reaction surface 24 of mating drive wedge member 14. Load application portion 90 of load application member 30 is sized larger than load application passage 28 of drive wedge member 14 so as to be constrained from passing therethrough when portable wedge clamp 10 is operated. Preferably, for ease of operation, a washer or other relatively rotatable rotational slip member 92 is positioned between load reaction surface 24 of mating drive wedge member 14 and load application portion 90 of load application member 30.

During operation, while portable wedge clamp device 10 is in its initial collapsed configuration, load application member 30 is loosely threaded into coupling with external anvil member A with target workpiece T positioned therebetween with sufficient spacing between external load application surface 22 and external anvil member A to permit movement of target workpiece T with respect to external anvil member A. Target workpiece T is positioned with respect to external anvil member A. Optionally, threaded coupling of load application member 30 with external anvil member A is snugged with target workpiece T lightly clamped therebetween. Else, threaded coupling of load application member 30 with external anvil member A is left in its loose state with target workpiece T moveable therebetween. Thereafter, actuation member 40 is operated in a first direction to draw drive wedge member 14 slidingly along wedge interface 20 from the initial collapsed configuration with base wedge member 12 toward the expanded configuration of wedge clamp 10. Drawing drive wedge member 14 slidingly along wedge interface 20 from the initial collapsed configuration with base wedge member 12 toward the expanded configuration of wedge clamp 10 causes opposing wedge interface surfaces 32, 34 of mating base wedge and drive wedge members 12, 14 to move apart from their minimum spacing in the initial collapsed configuration to their maximum spacing in the final expanded configuration. When base wedge and drive wedge members 12, 14 have reached the effective final expanded configuration with their opposing wedge interface surfaces 32, 34 spaced a maximum effective distance apart, load application member 30 is effectively tensioned along load application axis 31 in cooperating load application passages 26, 28 for pulling target workpiece T into an immovably clamped position against anvil member A. Subsequently, actuation member 40 can be operated in a second opposite direction to push drive wedge member 14 slidingly along wedge interface 20 from the effective expanded configuration of wedge clamp 10 back toward the initial collapsed configuration with base wedge member 12. Accordingly, opposing wedge interface surfaces 32, 34 of mating base wedge and drive wedge members 12, 14 are moved together from their effective maximum spacing in the expanded configuration back together toward their minimum spacing until the initial collapsed configuration is once more attained.

When base wedge and drive wedge members 12, 14 have attained the initial collapsed configuration with their opposing wedge interface surfaces 32, 34 spaced a minimum effective distance apart, load application member 30 is effectively relaxed along load application axis 31 in cooperating load application passages 26, 28 for permitting target workpiece T to move away from the immovably clamped position against anvil member A, whereby target workpiece T is loose and can be moved away from contact with anvil member A and repositioned relative thereto.

Figure 11:
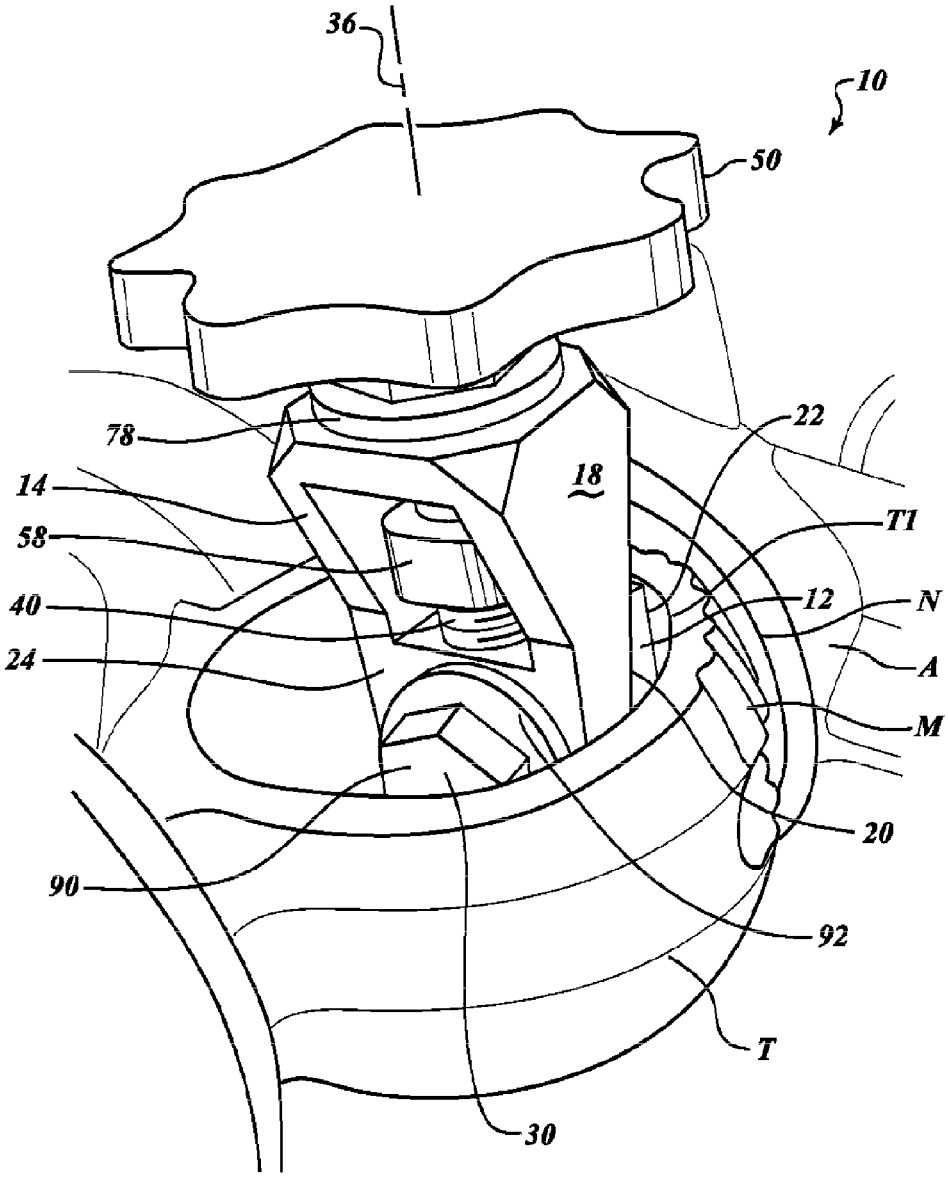
FIG. 11, FIG. 12 and FIG. 13 illustrate the same portable wedge clamp of the same invention illustrated in FIGS. 1 and 2 shown here in operation for clamping a target workpiece against an anvil member.
Figure 12:
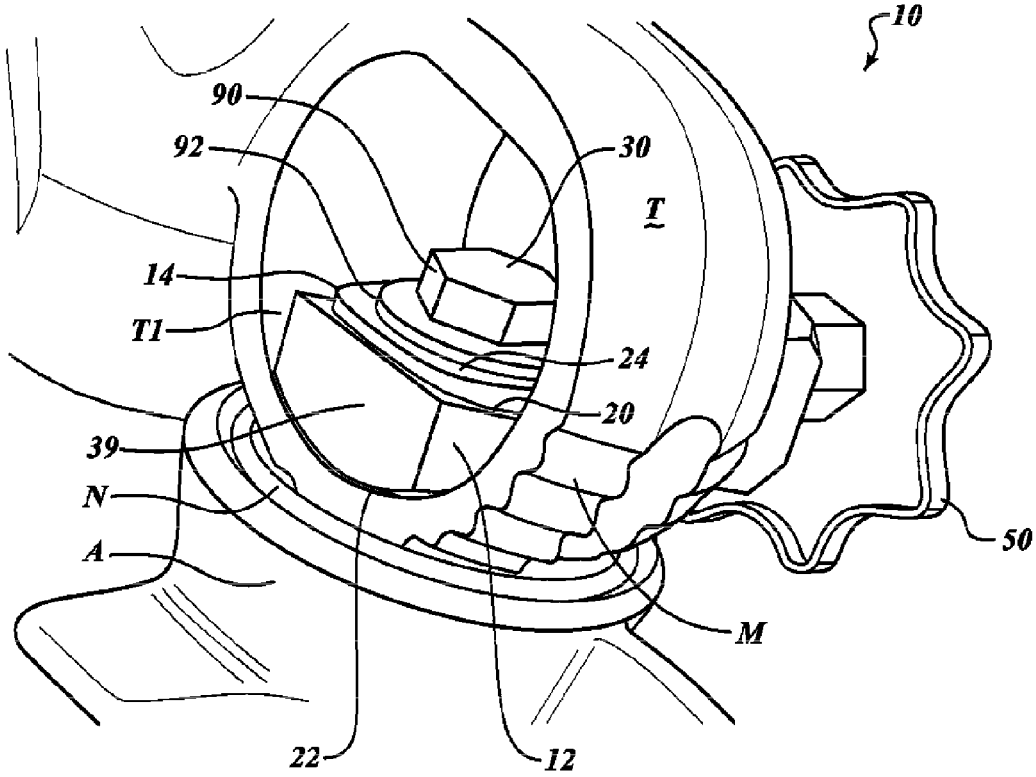
Figure 13:
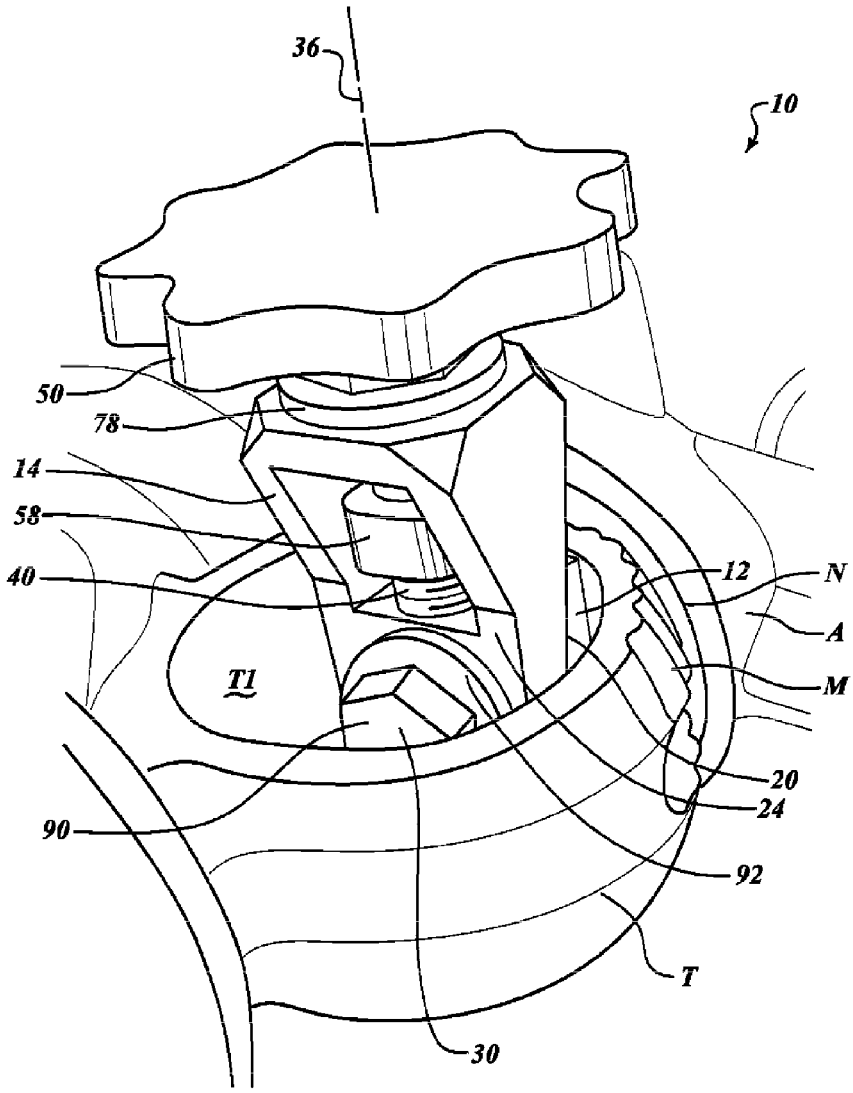

FIG. 11, FIG. 12 and FIG. 13 illustrate the portable wedge clamp 10 in operation for clamping target workpiece T against anvil member A. Here, by example and without limitation, an interface N between target workpiece T and anvil member A includes an interlock mechanism M, such as interlocking teeth or ridges as shown. Interlock mechanism M effectively secures the clamped relative positioning between target workpiece T and anvil member A.

While the preferred and additional alternative embodiments of the invention have been illustrated and described, it will be appreciated that various changes can be made therein without departing from the spirit and scope of the invention. Therefore, it will be appreciated that various changes can be made therein without departing from the spirit and scope of the invention. Accordingly, the inventor makes the following claims.

What is claimed is:

1. A portable wedge clamp device, comprising:

a base wedge member and a cooperating drive wedge member that are mutually slidable along a mutual wedge interface that is inclined therebetween, wherein:

the base wedge member further comprises a generally wedge shaped body comprising a load application surface with a wedge interface surface opposite therefrom and inclined at an angle relative thereto, a load application passage through the base wedge member positioned between a thin end thereof and a thick end opposite therefrom and communicating between the load application and wedge interface surfaces thereof, and an anchor portion adjacent to a thin end thereof opposite from the thick end thereof, and the drive wedge member further comprises a generally wedge shaped body comprising a load reaction surface with a wedge interface surface opposite therefrom and inclined at an angle relative thereto, an oblong load application passage through the drive wedge member adjacent to a thin end thereof and communicating between the load reaction and wedge interface surfaces and elongated between the thin end of the wedge shaped body and a thick end thereof opposite from the thin end, an actuator reaction portion adjacent to the thick end of the wedge shaped body and further comprising clearance formed between the load application passage and the actuator reaction portion and structured to accommodate movement of the anchor portion of the base wedge member therein relative to the inclined wedge interface, the respective wedge interface surfaces of the drive wedge member and the base wedge member being slidably matable along the wedge interface with the load reaction surface of the drive wedge member being substantially parallel with and spaced apart from the load application surface of the base wedge member, and the drive wedge member and the base wedge member being relatively slidably movable along the wedge interface that is inclined therebetween between an initial collapsed configuration wherein the load reaction surface of the drive wedge member is spaced apart at a minimum distance from the load application surface of the base wedge member and the load application passage of the base wedge member is substantially aligned with the oblong load application passage through the drive wedge member adjacent to the thin end of the wedge shaped body thereof, and a final expanded configuration wherein the load reaction surface of the drive wedge member is spaced apart at a maximum distance from the load application surface of the base wedge member and the load application passage of the base wedge member is substantially aligned with the oblong load application passage through the drive wedge member adjacent to the thick end of the wedge shaped body thereof;

a load application member comprising a shaft portion that is slidably movable in the aligned load application passages through the respective base wedge member and drive wedge member, the load application member further comprising: a threaded end portion extended from the shaft portion thereof and further extended externally of the load application surface of the base wedge member, and a load application portion extended from the shaft portion thereof opposite from the threaded end portion thereof and sized larger than a width of the load application passage of the drive wedge member and further extended externally of the load reaction surface of the drive wedge member; and an actuation member coupled between the anchor portion of the base wedge member and the actuator reaction portion of the drive wedge member for slidingly moving the drive wedge member relative to the base wedge member along the mutual wedge interface that is inclined therebetween.

2. The portable wedge clamp device of claim 1, wherein the mutual wedge interface is further inclined at an angle of about fifteen degrees plus or minus about five degrees between the base wedge member and the drive wedge member.

3. The portable wedge clamp device of claim 1, wherein the actuation member further comprises an actuator drive passage formed through the anchor portion thereof and communicating between an expansion drive surface and an contraction drive surface of the actuation member, and wherein the clearance formed between the load application passage and the actuator reaction portion further comprises clearance formed between the oblong load application passage through the drive wedge member and the contraction drive surface of the actuator reaction portion.

4. The portable wedge clamp device of claim 3, wherein the actuation member further comprises an actuation drive shaft portion extended through the actuator drive passage of the drive wedge member, and further comprising an expansion actuation portion coupled to the actuation drive shaft portion in a position adjacent to the expansion drive surface of the wedge shaped body of the drive wedge member, and a contraction actuation portion coupled to the actuation drive shaft portion in a position adjacent to the contraction drive surface of the wedge shaped body of the drive wedge member.

5. The portable wedge clamp device of claim 4, wherein the expansion drive surface of the wedge shaped body of the drive wedge member further comprises an exterior surface of the wedge shaped body, and the contraction drive surface of the wedge shaped body of the drive wedge member further comprises an interior surface thereof.

6. The portable wedge clamp device of claim 5, wherein the actuation drive shaft portion of the actuation member further comprises a threaded end portion that is threadedly engaged with a threaded portion of the anchor portion for moving the drive wedge member relative to the base wedge member along the mutual wedge interface between the collapsed configuration and the expanded configuration.

7. The portable wedge clamp device of claim 6, wherein the expansion actuation portion is further rotatable relative to the expansion drive surface of the wedge shaped body of the drive wedge member, and the contraction actuation portion is further rotatable relative to the contraction drive surface of the wedge shaped body of the drive wedge member.

8. The portable wedge clamp device of claim 1, wherein the load application member further comprises a rotational slip member between the load application portion and the load reaction surface of the drive wedge member.

9. The portable wedge clamp device of claim 8, wherein the rotational slip member is further rotatable relative to the load application portion of the load application member.

10. A portable wedge clamp device, comprising:

cooperating rigid base wedge and drive wedge members that are moveable relative to a wedge drive axis slidably along a mutual wedge interface that is inclined therebetween at an angle of about fifteen degrees plus or minus about five degrees relative to the drive axis, wherein:

the base wedge member further comprises a generally wedge shaped body comprising a load application surface with a wedge interface surface opposite therefrom and inclined at an angle of about fifteen degrees plus or minus about five degrees relative thereto, a substantially circular load application passage formed through the base wedge member along a load application axis approximately midway between opposing thick and thin ends thereof and communicating between the load application and wedge interface surfaces, and an anchor collar adjacent to the thin end thereof opposite from the thick end and further comprising a female thread formed therethrough, and the drive wedge member further comprises a generally wedge shaped body comprising a load reaction surface with a wedge interface surface opposite therefrom and inclined at an angle of about fifteen degrees plus or minus about five degrees relative thereto, an oblong load application passage formed through the drive wedge member adjacent to a thin end thereof and communicating between the load reaction and wedge interface surfaces and comprising an elongated dimension extended substantially along the drive axis between the thin end of the wedge shaped body and a thick end thereof opposite from the thin end, an actuator reaction portion adjacent to the thick end of the wedge shaped body and further comprising an actuator drive passage formed therethrough oriented substantially along the drive axis and communicating between an exterior expansion drive surface and an interior contraction drive surface thereof that are oriented substantially crosswise of the drive axis, and clearance formed between the load application passage and the interior contraction drive surface of the actuator reaction portion and sized to accommodate substantially linear movement of the anchor collar of the base wedge member therein substantially along the drive axis, the respective wedge interface surfaces of the drive wedge member and the base wedge member being slidably mated along at least a portion of the wedge interface with the load reaction surface of the drive wedge member being substantially parallel with the load application surface of the base wedge member and spaced apart therefrom, and the drive wedge member and the base wedge member are relatively slidably movable along the wedge interface that is inclined therebetween between an initial collapsed configuration wherein the load reaction surface of the drive wedge member is spaced apart along the load application axis at a minimum distance from the load application surface of the base wedge member and the load application passage of the base wedge member is substantially aligned with the oblong load application passage through the drive wedge member adjacent to the thin end of the wedge shaped body thereof, and a final expanded configuration wherein the load reaction surface of the drive wedge member is spaced apart along the load application axis at a maximum distance from the load application surface of the base wedge member and the load application passage of the base wedge member is substantially aligned with the oblong load application passage through the drive wedge member adjacent to the thick end of the wedge shaped body thereof;

a load application member comprising a shaft portion that is slidably movable along the load application axis in the aligned load application passages through the respective base wedge member and drive wedge member, the load application member further comprising: a threaded end portion extended from the shaft portion thereof and further extended externally of the load application surface of the base wedge member, and a load application portion extended from the shaft portion thereof opposite from the threaded end portion thereof and sized larger than a width of the load application passage of the drive wedge member and further extended externally of the load reaction surface of the drive wedge member; and an actuation member coupled between the anchor collar of the base wedge member and the actuator reaction portion of the drive wedge member and operable through the actuator drive passage of the drive wedge member for slidingly moving the drive wedge member relative to the base wedge member along the inclined mutual wedge interface alternately between the collapsed configuration and the expanded configuration.

11. The portable wedge clamp device of claim 10, wherein the actuation member further comprises an actuation drive shaft portion extended through the actuator drive passage of the drive wedge member and operably engaged with the anchor collar of the base wedge member, and further comprises an expansion actuation portion coupled to the actuation drive shaft portion in a position adjacent to the exterior expansion drive surface of the wedge shaped body of the drive wedge member and operable thereagainst for moving the drive wedge member relative to the base wedge member along the inclined mutual wedge interface toward the expanded configuration, and a contraction actuation portion coupled to the actuation drive shaft portion in a position adjacent to the interior contraction drive surface of the wedge shaped body of the drive wedge member and operable thereagainst for moving the drive wedge member relative to the base wedge member along the inclined mutual wedge interface toward the collapsed configuration.

12. The portable wedge clamp device of claim 11, wherein the anchor collar of the base wedge member further comprises a threaded portion, the actuation drive shaft portion of the actuation member further comprises a threaded portion that is threadedly engaged with the threaded portion of the anchor collar of the base wedge member.

13. The portable wedge clamp device of claim 12, wherein the expansion actuation portion is further rotatable relative to the exterior expansion drive surface of the wedge shaped body of the drive wedge member, and the contraction actuation portion is further rotatable relative to the interior contraction drive surface of the wedge shaped body of the drive wedge member.

14. The portable wedge clamp device of claim 10, wherein the load application member further comprises a rotational slip member between the load application portion and the load reaction surface of the drive wedge member.

15. The portable wedge clamp device of claim 14, wherein the rotational slip member is further rotatable relative to the load application portion of the load application member.

16. A method of clamping utilizing a portable wedge clamp device, the method comprising:

forming cooperating rigid base wedge and drive wedge members that are moveable relative to a wedge drive axis slidably along a mutual wedge interface that is inclined therebetween at an angle of about fifteen degrees plus or minus about five degrees relative to the drive axis, wherein:

forming the base wedge member further comprises forming a generally wedge shaped body comprising a load application surface with a wedge interface surface opposite therefrom and inclined at an angle of about fifteen degrees plus or minus about five degrees relative thereto, a substantially circular load application passage formed through the base wedge member along a load application axis approximately midway between opposing thick and thin ends thereof and communicating between the load application and wedge interface surfaces, and an anchor collar adjacent to the thin end thereof opposite from the thick end and further comprising a female thread formed therethrough, and forming the drive wedge member further comprises forming a generally wedge shaped body comprising a load reaction surface with a wedge interface surface opposite therefrom and inclined at an angle of about fifteen degrees plus or minus about five degrees relative thereto, an oblong load application passage formed through the drive wedge member adjacent to a thin end thereof and communicating between the load reaction and wedge interface surfaces and comprising an elongated dimension extended substantially along the drive axis between the thin end of the wedge shaped body and a thick end thereof opposite from the thin end, an actuator reaction portion adjacent to the thick end of the wedge shaped body and further comprising an actuator drive passage formed therethrough oriented substantially along the drive axis, and clearance formed between the load application passage and the actuator reaction portion and sized to accommodate substantially linear movement of the anchor collar of the base wedge member therein substantially along the drive axis, slidably mating the respective wedge interface surfaces of the drive wedge member and the base wedge member along at least a portion of the wedge interface with the load reaction surface of the drive wedge member being substantially parallel with the load application surface of the base wedge member and spaced apart therefrom, and slidingly moving the drive wedge member relative to the base wedge member substantially along the wedge interface that is inclined therebetween between an initial collapsed configuration wherein the load reaction surface of the drive wedge member is spaced apart along the load application axis at a minimum distance from the load application surface of the base wedge member and the load application passage of the base wedge member is substantially aligned with the oblong load application passage through the drive wedge member adjacent to the thin end of the wedge shaped body thereof, and a final expanded configuration wherein the load reaction surface of the drive wedge member is spaced apart along the load application axis at a maximum distance from the load application surface of the base wedge member and the load application passage of the base wedge member is substantially aligned with the oblong load application passage through the drive wedge member adjacent to the thick end of the wedge shaped body thereof;

providing a load application member comprising a shaft portion that is longer than the maximum distance between the load reaction surface of the drive wedge member and the load application surface of the base wedge member in the final expanded configuration, and is further slidably movable in the aligned load application passages through the respective base wedge member and drive wedge member, wherein providing the load application member further comprises providing: a threaded end portion extended from the shaft portion thereof, and a load application portion extended from the shaft portion thereof opposite from the threaded end portion thereof and sized larger than a width of the load application passage of the drive wedge member;

inserting the load application member through the aligned load application passages through the respective base wedge member and drive wedge member with the load application portion positioned externally of the load reaction surface of the drive wedge member and the threaded end portion extended from the load application surface of the base wedge member;

coupling an actuation member between the anchor collar of the base wedge member and the actuator reaction portion of the drive wedge member in a fashion operable through the actuator drive passage of the drive wedge member for slidingly moving the drive wedge member relative to the base wedge member along the inclined mutual wedge interface alternately between the collapsed configuration and the expanded configuration.

17. The method of claim 16, further comprising:

with the cooperating base wedge and drive wedge members in the collapsed configuration, inserting the load application member through a complementary hole through a target workpiece that is to be clamped, wherein the threaded end portion thereof is further extended from the hole through the target workpiece opposite from the load application surface of the base wedge member;

coupling to a an anvil member on an opposite side of the target workpiece from the base wedge the threaded end portion of the load application member that is extended from the hole through the target workpiece;

operating the actuation member through the actuator drive passage of the drive wedge member for slidingly moving the drive wedge member relative to the base wedge member along the inclined mutual wedge interface between the collapsed configuration and the expanded configuration.

18. The method of claim 17, wherein coupling an actuation member between the anchor collar of the base wedge member and the actuator reaction portion of the drive wedge member further comprises threadedly engaging a portion of the actuation member with the anchor collar of the base wedge member, and rotating the actuation member relative to the anchor collar; and wherein operating the actuation member through the actuator drive passage of the drive wedge member further comprises moving the load reaction surface of the drive wedge member away from the load application surface of the base wedge member substantially along the load application axis.

19. The method of claim 18, further comprising initially at least partially tightening the load application member with the anvil member with the target workpiece therebetween before operating the actuation member for moving the drive wedge member relative to the base wedge member between the collapsed configuration and the expanded configuration.

20. The method of claim 19, wherein forming the drive wedge member further comprises forming an exterior expansion drive surface and an interior contraction drive surface thereof that are oriented substantially crosswise of the drive axis with the actuator drive passage thereof communicating between the exterior expansion drive surface and the interior contraction drive surface thereof;

wherein coupling an actuation member between the anchor collar of the base wedge member and the actuator reaction portion of the drive wedge member in a fashion operable through the actuator drive passage of the drive wedge member further comprises coupling an expansion actuation portion of the actuation member in a position adjacent to the exterior expansion drive surface of the wedge shaped body of the drive wedge member and operable thereagainst for moving the drive wedge member relative to the base wedge member along the inclined mutual wedge interface toward the expanded configuration, and coupling a contraction actuation portion of the actuation member in a position adjacent to the interior contraction drive surface of the wedge shaped body of the drive wedge member and operable thereagainst for moving the drive wedge member relative to the base wedge member along the inclined mutual wedge interface toward the collapsed configuration; and wherein operating the actuation member through the actuator drive passage of the drive wedge member for slidingly moving the drive wedge member relative to the base wedge member along the inclined mutual wedge interface between the collapsed configuration and the expanded configuration further comprises moving the load reaction surface of the drive wedge member away from the load application surface of the base wedge member substantially along the load application axis.

* * * * *